US008857868B2

(12) United States Patent
Liang et al.

(10) Patent No.: US 8,857,868 B2
(45) Date of Patent: Oct. 14, 2014

(54) ENGAGING MECHANISM OF CLOSING DEVICE

(75) Inventors: Hsiu-Chiang Liang, Kaohsiung (TW); Ken-Ching Chen, Kaohsiung (TW); Chun-Chiang Wang, Kaohsiung (TW)

(73) Assignee: King Slide Works Co., Ltd., Kaosiung (TW)

( * ) Notice: Subject to any disclaimer, the term of this patent is extended or adjusted under 35 U.S.C. 154(b) by 522 days.

(21) Appl. No.: 13/161,621

(22) Filed: Jun. 16, 2011

(65) Prior Publication Data

US 2012/0319412 A1 Dec. 20, 2012

(51) Int. Cl.
*E05B 15/02* (2006.01)

(52) U.S. Cl.
USPC ..... 292/340; 292/DIG. 4

(58) Field of Classification Search
USPC ..... 292/340
See application file for complete search history.

(56) References Cited

U.S. PATENT DOCUMENTS

| | | | | |
|---|---|---|---|---|
| 5,040,833 | A | 8/1991 | Brunnert | |
| 5,090,751 | A * | 2/1992 | Kobayashi | 292/71 |
| 7,097,220 | B2 * | 8/2006 | Haba | 292/341 |
| 7,347,515 | B1 | 3/2008 | Lu | |
| 7,374,261 | B1 | 5/2008 | Wang | |
| 7,413,270 | B2 | 8/2008 | Chang et al. | |
| 7,537,296 | B2 * | 5/2009 | Leon et al. | 312/333 |

FOREIGN PATENT DOCUMENTS

EP 0743032 A2 11/1996

* cited by examiner

*Primary Examiner* — Mark Williams
(74) *Attorney, Agent, or Firm* — Rosenberg, Klein & Lee

(57) ABSTRACT

An engaging mechanism of a closing device includes an engaging block, a positioning hook and a pin. The engaging block has a contact surface and a guide surface extending from the contact surface. The positioning hook is connected to the engaging block and has a resilient portion and a stop which extends from the resilient portion. The stop is located adjacent to the contact surface and located at a distance from the guide surface. The pin is located corresponding to the engaging block and slidably contacts the contact surface and the stop of the positioning hook. The pin moves over the stop and is disengaged from the contact surface by contacting against the stop and the deformation of the resilient portion.

6 Claims, 6 Drawing Sheets

ENGAGING MECHANISM OF CLOSING DEVICE

FIELD OF THE INVENTION

The present invention relates to an engaging mechanism of a closing device, and more particularly, to an engaging mechanism for a closing device between two pieces of furniture so that when any one of the two pieces is improperly opened, the closing device is protected.

BACKGROUND OF THE INVENTION

U.S. Pat. No. 5,040,833 to Brunnert discloses a "closing device for drawers" includes a drawer installed to a piece of furniture and the drawer is movable between a closed position and an opened position on the piece of furniture. A spring is located between the drawer and the piece of the furniture. A closing device is connected to the piece of the furniture and includes a holding member 9 which has a hook-shaped end 9'. A latch member 11 is connected to the drawer and is a board with two raised areas 12, 13, wherein the raised area 12 defines a notch 14. When the drawer is located at the closed position, the notch is engaged with the hook-shaped end of the holding member. Furthermore, the two raised areas define at least two different guide tracks which guide the holding member. When the drawer is movable between the closed and opened positions, the holding member is guided by the two different guide tracks and bent. When the drawer is pulled out from the piece of the furniture improperly, the deformation of the holding member makes the hook-shaped end be disengaged from the notch. When a force pushes the drawer which is at its closed position, the hook-shaped end of the holding member is movable and disengaged from the latch member so that the drawer pops out from the piece of the furniture in response to the force generated by the spring.

The above-mentioned is a closing device for a drawer and the correct way of use is to push the drawer to open the drawer. If an improper force is applied to the drawer, such as to pull the drawer outward, although the hook-shaped end of the holding member can be disengaged from the notch, the notch of the holding member is scraped by the hook-shaped end of the holding member, so that the notch and the holding ember both are worn after several times of this type of operation. The holding member tends to be disengaged from the notch frequently and the positioning feature fails.

The present invention intends to provide an improved design to overcome the shortcomings mentioned above.

SUMMARY OF THE INVENTION

The present invention relates to an engaging mechanism of a closing device, and more particularly, to an engaging mechanism for a closing device between two pieces of furniture. The engaging mechanism includes a contact surface which is cooperated with a stop of a positioning hook and a resilient portion of the positioning hook to make a part firmly contact the contact surface. When the part is applied by a force, the part contacts against the contact surface and the stop, the stop is disengaged from the contact surface by the deformation of the resilient portion.

The engaging mechanism of a closing device and comprises an engaging block which has a contact surface and a guide surface extending from the contact surface. A positioning hook is connected to the engaging block and has a resilient portion and a stop which extends from the resilient portion. The stop is located adjacent to the contact surface and located at a distance from the guide surface. A pin is located corresponding to the engaging block and slidably contacts the contact surface and the stop of the positioning hook. The pin moves over the stop and is disengaged from the contact surface by contacting against the stop and by the deformation of the resilient portion.

Preferably, the positioning hook integrally extends from the engaging block.

Preferably, a buffering space is defined beside the positioning hook and the resilient portion of the positioning hook is operated within the buffering space.

Preferably, the engaging block has a slot and the positioning hook is connected to an insertion to form an independent part. A buffering space is defined between the positioning hook and the insertion. The insertion is inserted into the slot and is connected to the engaging block.

Preferably, a groove communicates with the slot. The insertion has a protrusion. The insertion is engaged with the slot when the protrusion is engaged with the groove.

Preferably, the insertion has an opening defined by two legs, and at least one of the legs has a boss.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
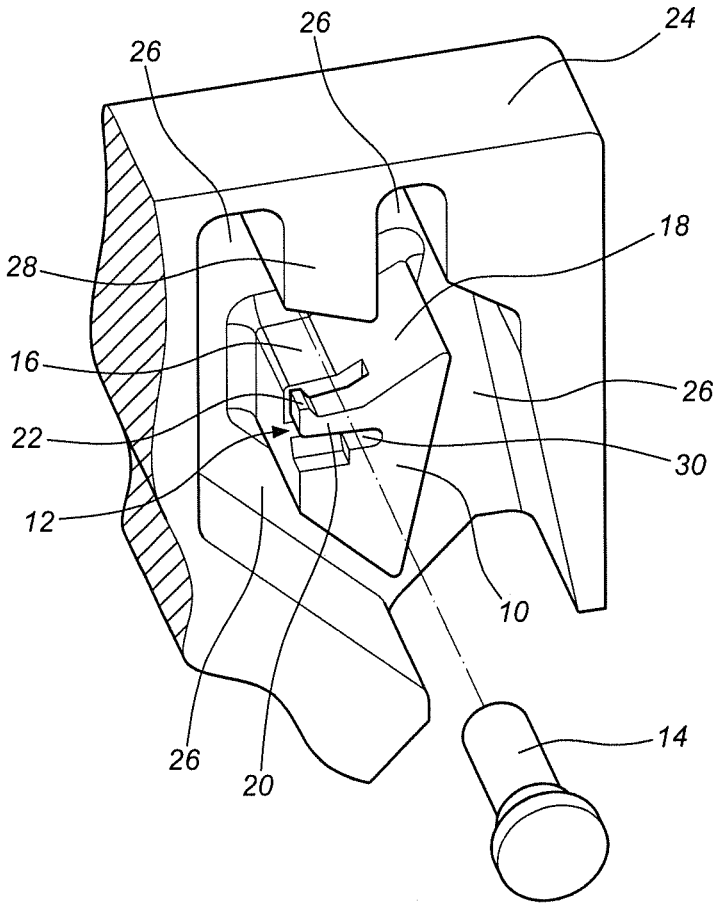
FIG. 1 shows a part of the engaging block and the pin of the engaging mechanism of the present invention.
Figure 2:
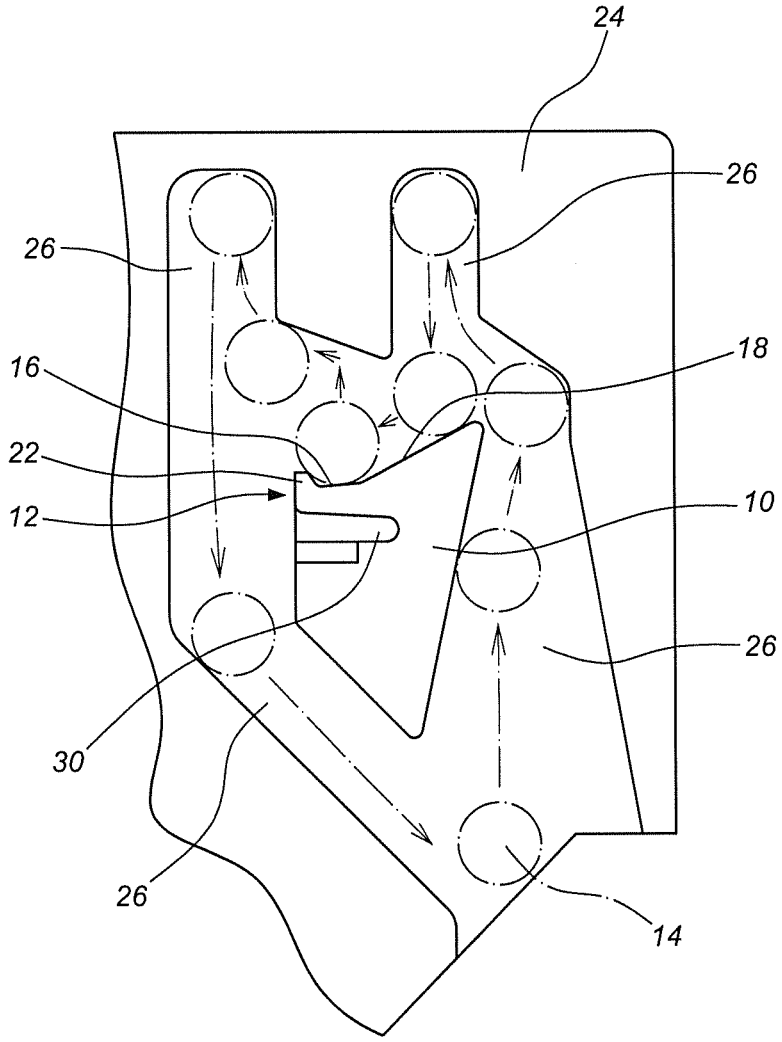
FIG. 2 shows the movement of the pin in the guide path of the contact member of the engaging mechanism of the present invention.

Referring to FIGS. 1 and 2, the engaging mechanism of a closing device of the present invention comprises an engaging block 10, a positioning hook 12 and a pin 14.

The engaging block 10 comprises a contact surface 16 and a guide surface 18 extending from the contact surface 16. The positioning hook 12 is connected to the engaging block 10 and comprises a resilient portion 20 and a stop 22 which extends from the resilient portion 20. The stop 22 is located adjacent to the contact surface 16 and located at a distance from the guide surface 18. The pin 14 is located corresponding to the engaging block 10 and slidably contacts the contact surface 16 and the stop 22 of the positioning hook 12.

In this embodiment, the engaging block 10 is located on a contact member 24 which includes a guide path 26 defined around the engaging block 10, and a guide block 28 which is located corresponding to the contact surface 16 of the engaging block 10 and the positioning hook 12. When the contact member 24 and the pin 14 have relative movement, the guide path 26 and the guide block 28 are used to guide the pin 14 to contact the engaging block 10, or to guide the pin 14 to disengage from the engaging block 10.

In this embodiment, the positioning hook 12 integrally extends from the engaging block 10.

In this embodiment, a buffering space 30 is defined beside the positioning hook 12 and the resilient portion 20 of the positioning hook 12 is operated within the buffering space 30.

Figure 3:
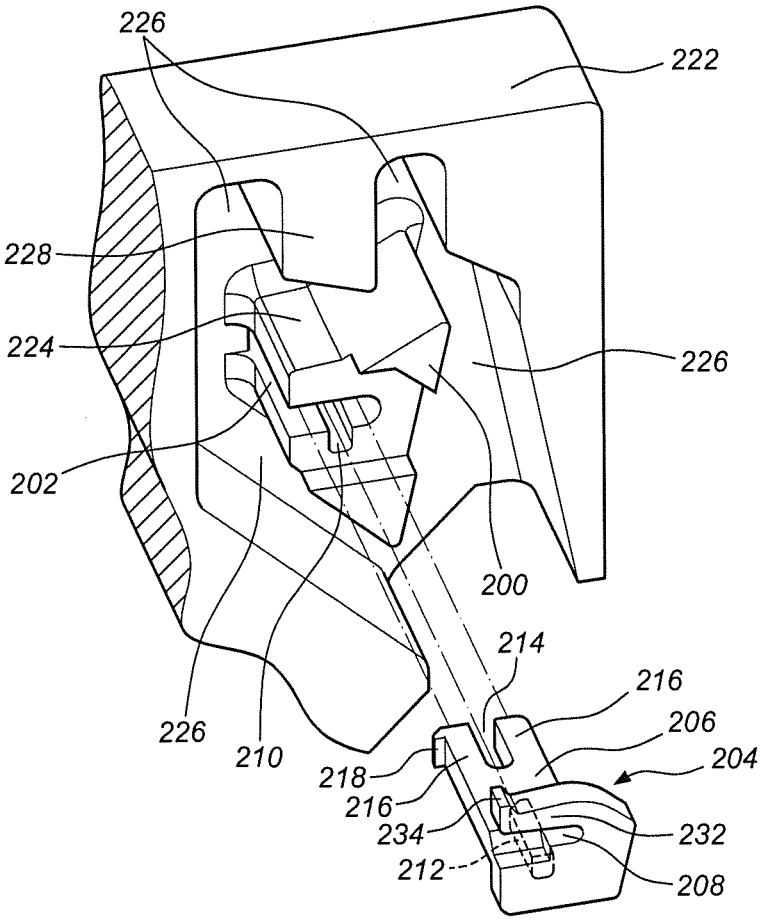
FIG. 3 shows a part the engaging block and the pin of the second embodiment of the engaging mechanism of the present invention.
Figure 4:
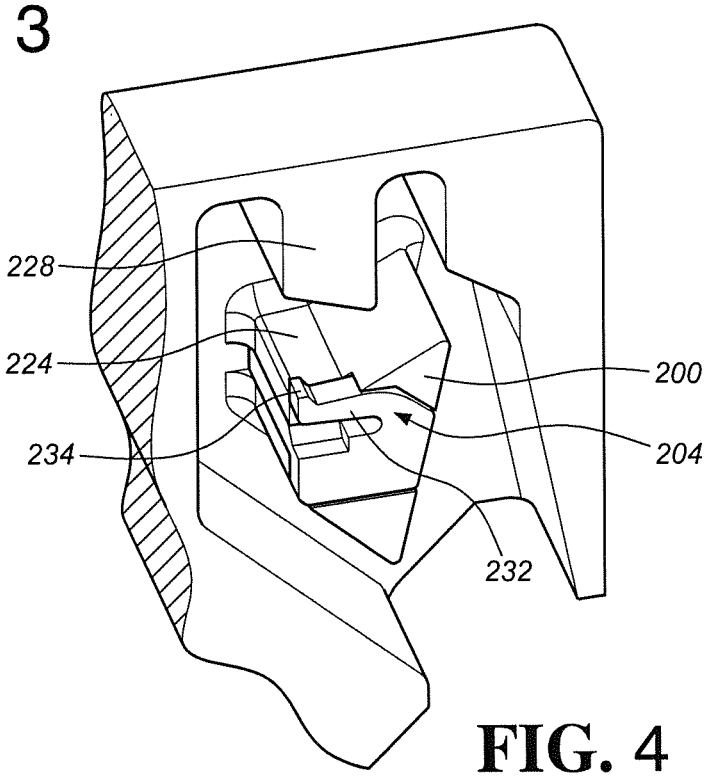
FIG. 4 is a perspective view to show the second embodiment of the engaging mechanism of the present invention.
Figure 5:
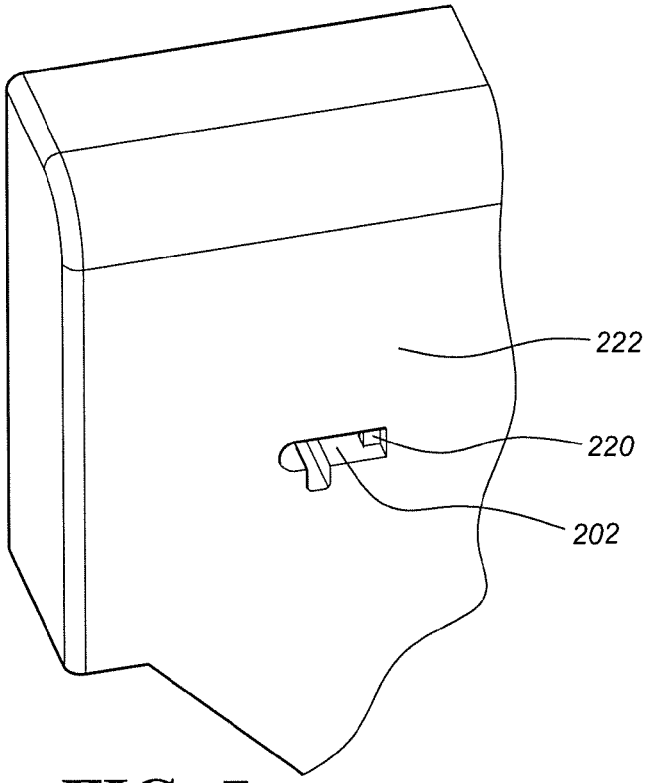
FIG. 5 shows the slot in the engaging block of the second embodiment of the engaging mechanism of the present invention.
Figure 6:
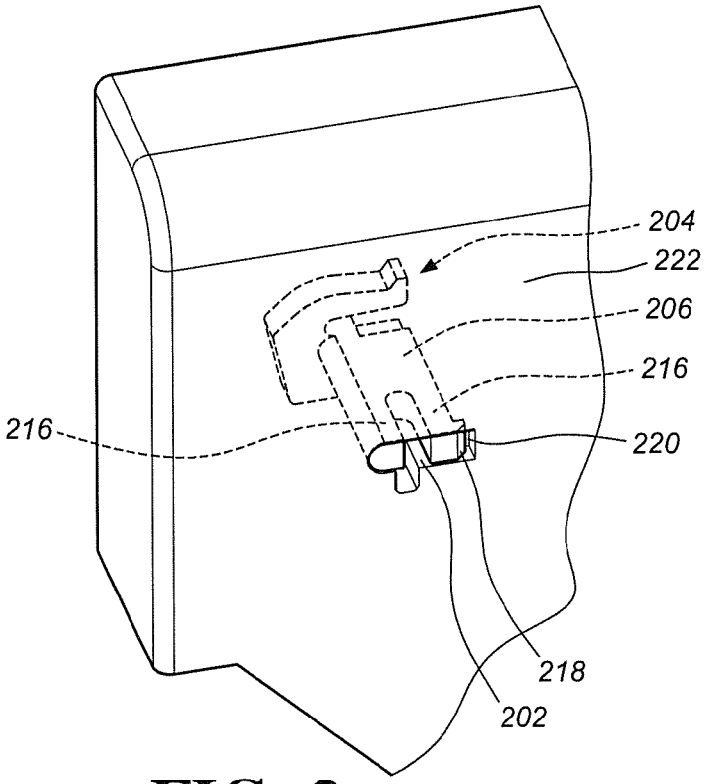
FIG. 6 shows that the positioning hook is inserted into the slot of the engaging block of the second embodiment of the engaging mechanism of the present invention.

FIGS. 3 and 4 show the second embodiment of the present invention, wherein the engaging block 200 has a slot 202 and the positioning hook 204 is connected to an insertion 206 to form an independent part. A buffering space 208 is defined between the positioning hook 204 and the insertion 206. The insertion 206 is inserted into the slot 202 and is connected to the engaging block 200. A groove 210 communicates with the slot 202. The insertion 206 has a protrusion 212. The insertion 206 is engaged with the slot 202 when the protrusion 212 is engaged with the groove 210, so that the positioning hook 204 is selectively connected to the engaging block 200 to correct the positioning hook 204 and the engaging block 200. For convenience of assembling and secured, the insertion 206 has an opening 214 defined in a distal end thereof and the opening 214 is defined by two legs 216. At least one of the legs 216 has a boss 218. The slot 202 of the engaging block 200 has a notch 220 which is located corresponding to the boss 218, as shown in FIGS. 5 and 6. The boss 218 of the leg 216 is engaged with the notch 220 to firmly insert the insertion 206 of the positioning hook 204 into the slot 202.

In the second embodiment, the engaging block 200 is connected on the contact member 222 and has a contact surface 224. The contact member 222 has a guide path 226 defined around the engaging block 200, and a guide block 228 which is located corresponding to the contact surface 224 of the engaging block 200 and the positioning hook 204. The positioning hook 204 has a resilient portion 232 and a stop 234 extends from the resilient portion 232.

Figure 7:
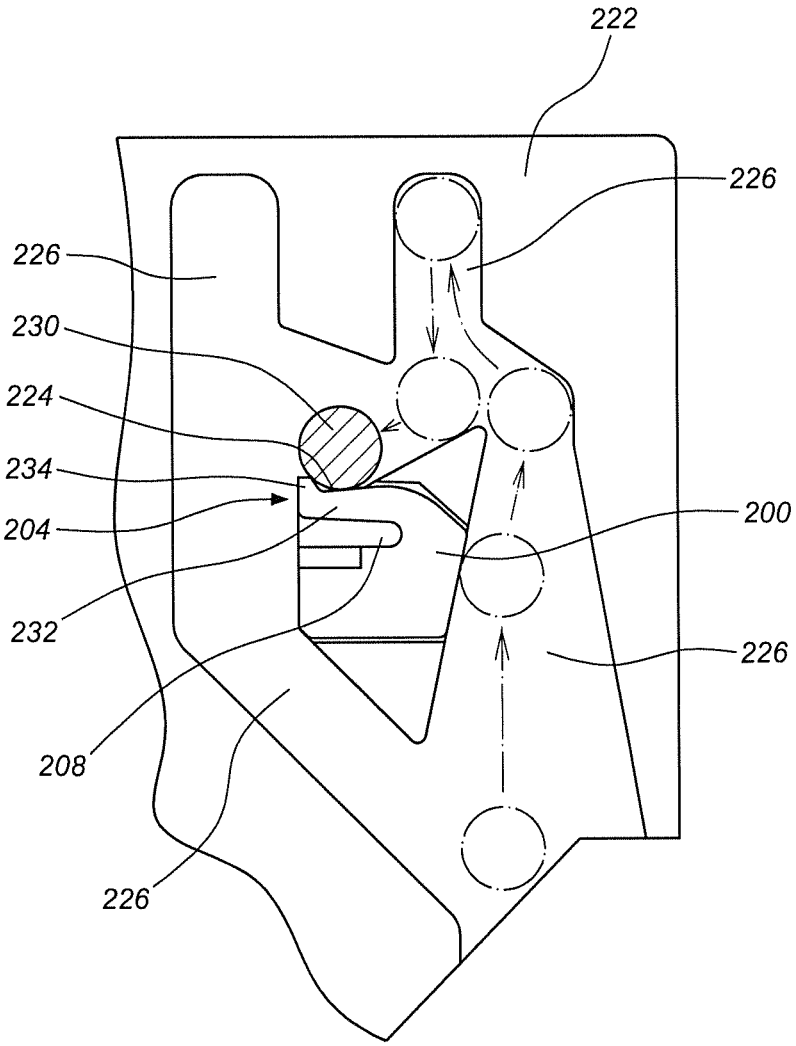
FIG. 7 shows that the pin contacts the contact surface of the engaging block via the guide path of the second embodiment of the engaging mechanism of the present invention.

As shown in FIG. 7, taken the second embodiment as an example, when the contact member 222 and the pin 230 have relative movement, the pin 230 is guided by the guide path 226 to contact the contact surface 224 of the engaging block 200 and the pin 230 is stopped by the stop 234 of the positioning hook 204. The pin 230 stays at the contact position and does not disengage from the contact position.

Figure 8:
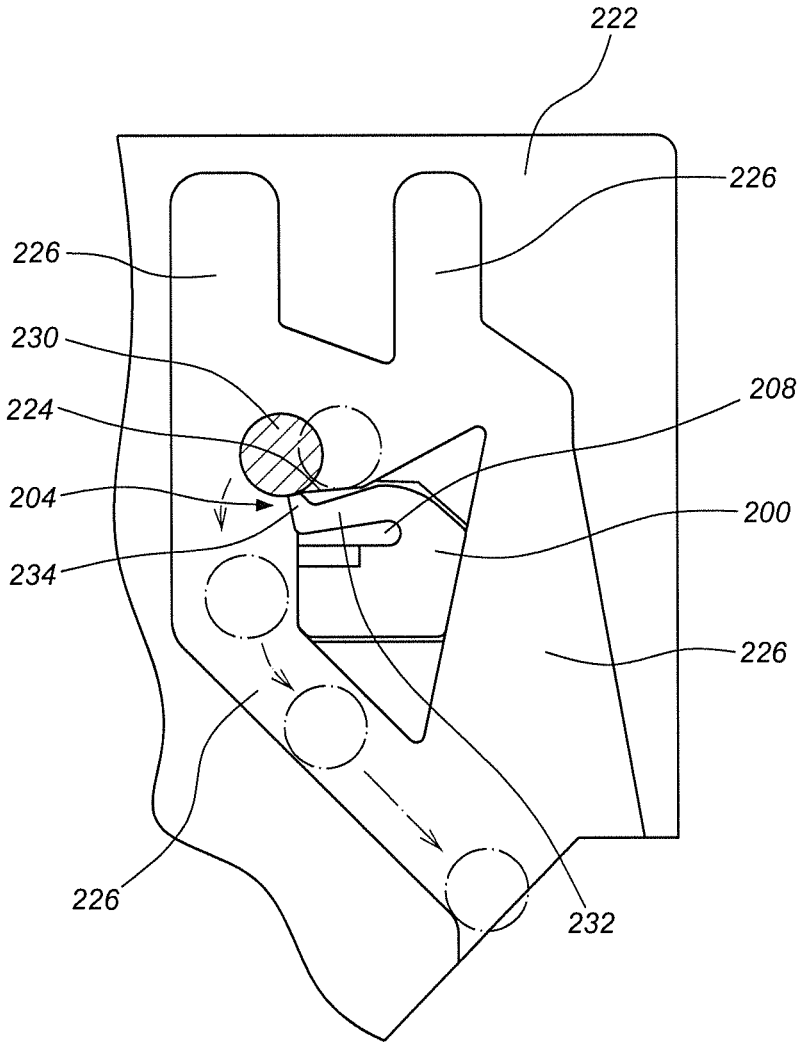
FIG. 8 shows that when a force pushes the pin toward the engaging block of the second embodiment, the pin is disengaged from the contact surface of the engaging block.

When a force pushes the pin 230 toward the engaging block 200, as shown in FIG. 8, the pin 230 moves over the contact surface 224 and pushes the stop 234 of the positioning hook 204. By the deformation of the resilient portion 232, the stop 234 is pushed by the pin 230 and the pin 230 moves over the stop 234 and is disengaged from the contact surface 224.

The present invention is applied to a fixed part and a movable part of furniture, for example, the fixed part is a cabinet or a fixed rail, and the movable part is a drawer or a movable rail. Taken the cabinet and the drawer as an example, the contact member 24(222) of the engaging block 10(200) is fixed to the cabinet and the pin 14(230) is movably connected to the drawer with the contact member 24(222) by guidance of the guide path 26(226). When the drawer is pushed into the cabinet, the pin 24(230) contacts the contact surface 16(224) of the engaging block 10(200), and by the contact of the stop 22(234) of the positioning hook 12(204), the drawer is kept at the closed position. When the drawer is pushed toward the cabinet, the pin 14(230) is guided by the guide block 28(228) and disengaged from the contact surface 16(224) of the engaging block 10(200). The drawer is then freely pulled out from the cabinet. When the drawer is pulled by an improper force, the pin 14(230) is disengaged from the contact surface 16(224) of the engaging block 10(200), while the stop 22(234) of the positioning hook 12(204) is not damaged and the positioning feature does not fail.

While we have shown and described the embodiment in accordance with the present invention, it should be clear to those skilled in the art that further embodiments may be made without departing from the scope of the present invention.

What is claimed is:

1. An engaging mechanism of a closing device, said engaging mechanism comprising:

a contact member having a first recess and a second recess formed therein, said first recess formed in a first section of said contact member, said second recess formed in a second section of said contact member, and an engaging block mounted to said contact member defining a guide path for a pin secured to a sliding rail;

a resilient positioning hook connected to the engaging block and having a stop member; and upon displacement of said pin in a first direction in said first section, said pin being biased in said first recess to displace to an inclined surface of said engaging block to bear against said stop member;

wherein when said pin is displaced further in said first direction, the pin is displaced into said second recess, said pin being biased in said second recess into said second section for removal of the pin from said guide path, and when said pin is displaced in a second direction, said stop member is displaced to allow said pin to enter said second section of said guide path for removal of said pin from said guide path.

2. The engaging mechanism as claimed in claim 1, wherein the resilient positioning hook integrally extends from the engaging block.

3. The engaging mechanism as claimed in claim 2, wherein a buffering space is defined beside the resilient positioning hook and the stop member of the resilient positioning hook is operated within the buffering space.

4. The engaging mechanism as claimed in claim 1, wherein the engaging block has a slot therein and the resilient positioning hook is connected to a projecting member, a buffering space is defined between the resilient positioning hook and the projecting member, the projecting member is matingly engaged to the slot and is connected to the engaging block.

5. The engaging mechanism as claimed in claim 4, wherein a groove communicates with the slot, the projecting member has a protrusion, the projecting member is engaged with the slot when the protrusion is engaged with the groove.

6. The engaging mechanism as claimed in claim 4, wherein the projecting member has an opening defined by two legs, at least one of the legs has a boss.

* * * * *